US007157995B2

(12) United States Patent
Nishida et al.

(10) Patent No.: US 7,157,995 B2
(45) Date of Patent: Jan. 2, 2007

(54) SWITCHING DEVICE

(75) Inventors: Takeshi Nishida, Muko (JP); Yasuyuki Masui, Otsu (JP); Takeshi Miyasaka, Otsu (JP)

(73) Assignee: Omron Corporation, Kyoto (JP)

( * ) Notice: Subject to any disclaimer, the term of this patent is extended or adjusted under 35 U.S.C. 154(b) by 57 days.

(21) Appl. No.: 11/014,638

(22) Filed: Dec. 16, 2004

(65) Prior Publication Data

US 2005/0146405 A1 Jul. 7, 2005

(30) Foreign Application Priority Data

Dec. 22, 2003 (JP) ..... P2003-424980

(51) Int. Cl.
*H01H 67/02* (2006.01)

(52) U.S. Cl. ..... 335/126; 335/78; 335/128

(58) Field of Classification Search ..... 335/126, 335/78, 127

See application file for complete search history.

(56) References Cited

U.S. PATENT DOCUMENTS 4,616,114 A * 10/1986 Strasser ..... 200/83 J
5,519,370 A 5/1996 Perreira et al.
5,525,948 A * 6/1996 Poulsen ..... 335/128
2004/0066261 A1 4/2004 Nishida et al.

FOREIGN PATENT DOCUMENTS

JP 05133705 A * 10/1991
JP 510040 10/1997
WO WO 95/24051 9/1995

OTHER PUBLICATIONS

Patent Abstracts of Japan; Publication No. 2002-233201 dated Aug. 20, 2002 (1 page) (corresponds to AB above—U.S. Pub. No. US2004/0066261A1).

* cited by examiner

*Primary Examiner*—Elvin Enad
*Assistant Examiner*—Bernard Rojas
(74) *Attorney, Agent, or Firm*—OshanLiang L.L.P.

(57) ABSTRACT

An electromagnetic relay has an iron core having a protruding shaft and a magnetic pole portion. The protruding shaft is penetrated through a through hole provided on a metal case, and coil is wound around the protruding shaft. A voltage is applied to the coil for magnetization and stopped for demagnetization, hence to drive a contact mechanism with a movable iron piece that is attracted by and separated from the magnetic pole portion, thereby causing a reciprocating motion of the movable iron piece. The relay can prevent generation of eddy current.

8 Claims, 18 Drawing Sheets

SWITCHING DEVICE

BACKGROUND OF THE INVENTION

1. Field of the Invention

The present invention relates to an electromagnetic relay.

2. Description of the Related Art

As the electromagnetic relay for shutting off direct currents, there has been a hermetically sealed relay, for example, disclosed in Japanese Patent Article 1.

Specifically, a plunger 9 contacts with or separates from a core center 4 according to magnetization or demagnetization of a coil 26 within a hollow cavity 40, and an armature assembly 8 and an armature shaft 10 integrated with the plunger 9 slide in a direction of the shaft, so that a movable contact disk 21 contacts with or separates from fixed contacts 22 and 22.

[Patent Article 1] International Patent Publication No. 510040/1997

In the above-mentioned hermetically sealed relay, however, after a voltage is applied to the coil 26 so to excite it, when the voltage stops in order to return the plunger 9, the eddy currents generated according to a change of the magnetic flux flow into the core center 4 to produce a new magnetic flux, which inhibits the return operation of the plunger 9. According to this, since the armature shaft 10 and the movable contact disk 21 cannot move away from the fixed contacts 22 and 22 quickly and the arc keeps for a while, there is a fear of damaging the contacts and there is a problem that a desired switching characteristic cannot be obtained.

Taking the above problem into consideration, the invention is to provide an electromagnetic relay that can perform a quick return operation of a movable iron piece free from a fear of welding the contacts by preventing the generation of magnetic flux due to the eddy currents.

SUMMARY OF THE INVENTION

In order to achieve the above object, the electromagnetic relay according to the invention is designed in that an iron core is penetrated through a through hole provided on a metal case, a coil is wound around a protruding shaft, and a voltage is applied to the coil for magnetization and stopped for demagnetization, hence to drive a contact mechanism with a movable iron piece that is going and returning, attracted by and separated from a magnetic pole portion of the iron core, and eddy current generation preventing means for preventing generation of eddy current is provided on the opening end of the through hole formed on the metal case.

According to the invention, thanks to the eddy current generation preventing means provided on the opening end of the through hole of the metal case, no eddy current flows around the iron core and a new magnetic flux that disturbs the return operation of the movable iron piece does not occur. Therefore, since the movable iron piece can be quickly separated from the magnetic pole portion of the iron core and the arc can be quickly cut, it is possible to restrain the damage of the contact and to obtain a desired switching characteristic.

As the embodiment, the eddy current generation preventing means may be at least one slit or at least one thin portion provided on the opening end of the through hole.

According to the embodiment, thanks to the slit or the thin portion, since the electrical resistance increases, no eddy current flows or eddy current is difficult to flow and a magnetic flux caused by the eddy current does not occur.

Therefore, a desired switching characteristic can be obtained without disturbing the return operation of the movable iron piece.

An electromagnetic relay according to another invention is designed in that an iron core is penetrated through a through hole provided on a stainless steel case, a coil is wound around a protruding shaft, and a voltage is applied to the coil for magnetization and stopped for demagnetization, thereby driving a contact mechanism with a movable iron piece that is going and returning, attracted by and separated from a magnetic pole portion of the iron core.

According to the invention, since the stainless steel case itself is of low conductivity and it is difficult to flow the eddy current, a new magnetic flux that disturbs the return operation of the movable iron piece does not occur. Therefore, the movable iron piece can be quickly separated from the magnetic pole portion of the iron core and the arc can be quickly cut, thereby restraining the damage of the contact and obtaining a desired switching characteristic.

As another embodiment of the invention, at least one slit or at least one thin portion for preventing generation of eddy current may be provided on the opening end of the through hole provided on the stainless steel case.

According to the embodiment, thanks to the slit or the thin portion, since the electrical resistance increases, no eddy current flows or eddy current is difficult to flow. Therefore, a new magnetic flux that disturbs the return operation of the movable iron piece does not occur and an electromagnetic relay free from a fear of welding the contact can be obtained.

DETAILED DESCRIPTION OF THE INVENTION

A preferred embodiment of the invention will be described according to the accompanying drawings of FIG. 1 to FIG. 18.

Figure 1:
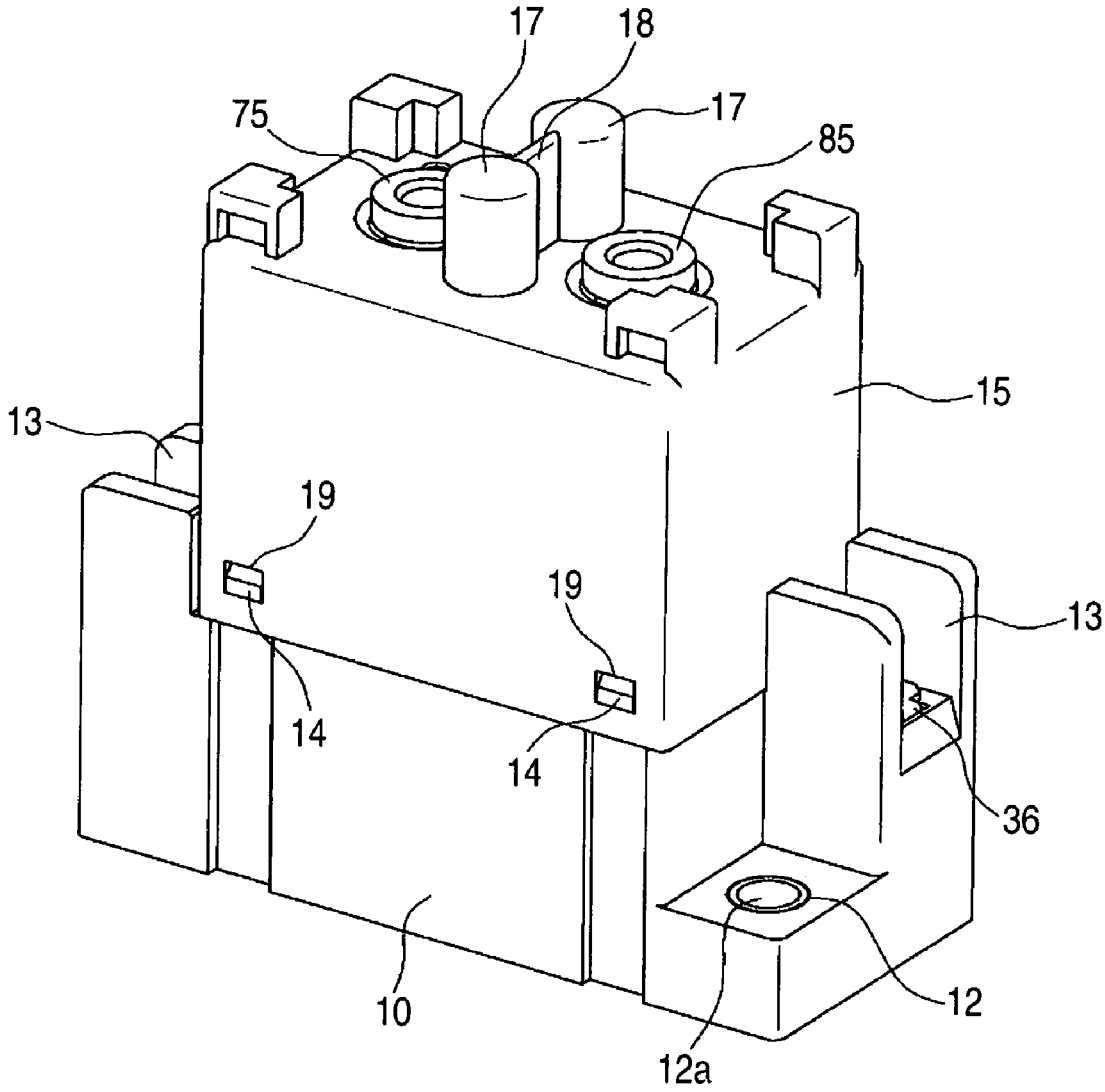
FIG. 1 is a perspective view showing the embodiment in the case where a switching device according to the invention is applied to a direct current breaking relay.
Figure 2:
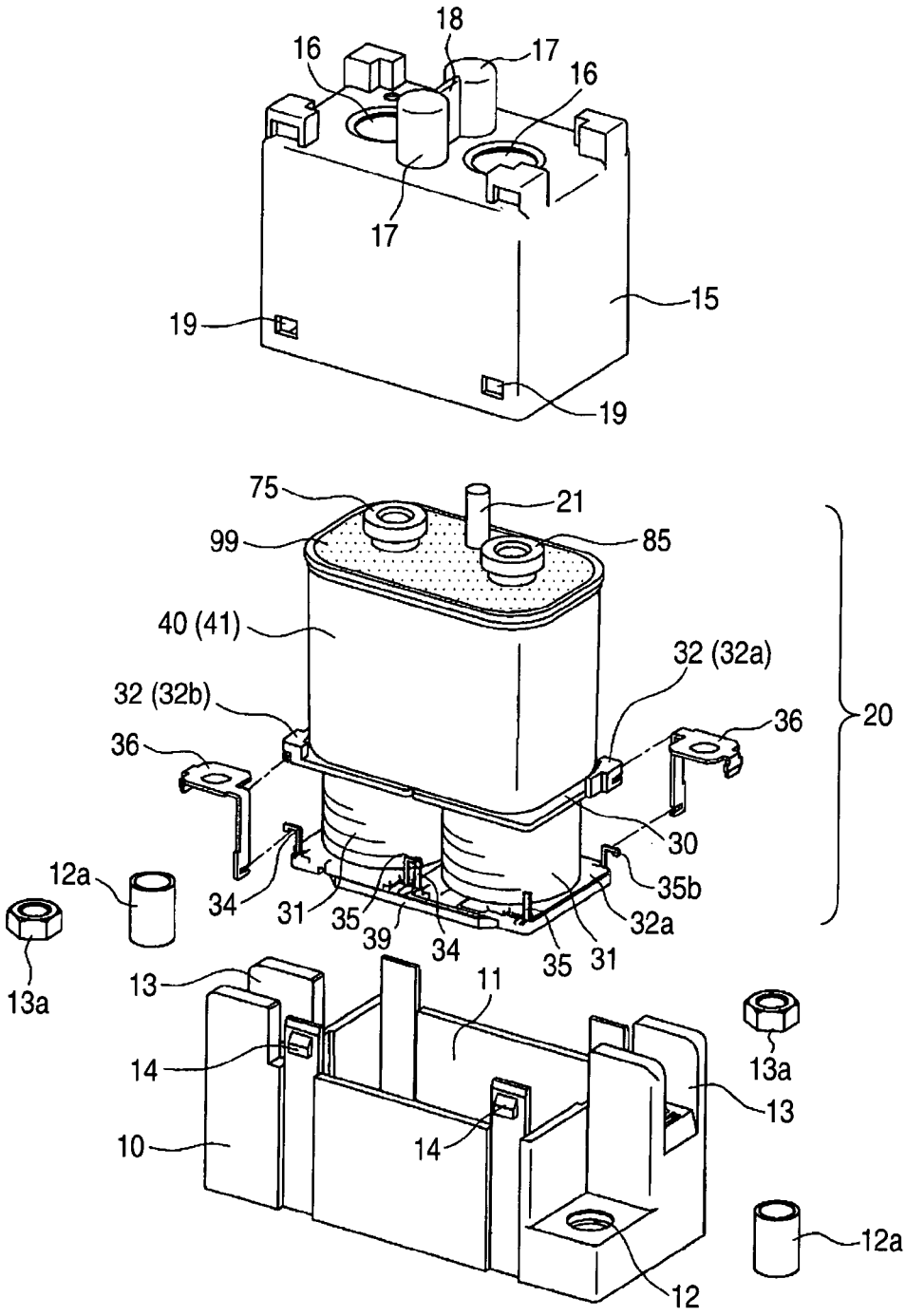
FIG. 2 is an exploded perspective view of FIG. 1.

This description will be made in the case where this embodiment is used for a relay for switching a direct current load, and as illustrated in FIG. 1 and FIG. 2, the main body of a relay 20 is housed in a space integrally formed by a box case 10 and a box cover 15.

The box case 10 has a recessed portion 11 capable of housing an electromagnetic block 30 described later, and it is provided with through holes 12 for fixing respectively at two corners positioned on one of the diagonal lines and with jointing concaves 13 at the remaining two corners, as illustrated in FIG. 2. A reinforcing cylinder 12*a* is inserted into each of the through holes 12 and a joint nut 13*a* is inserted into each of the jointing concaves 13.

The box cover 15 can be fixed to the box case 10 and it has a shape capable of housing a sealing case block 40 described later. The box cover 15 is provided with contact holes 16 and 16 from which contact terminals 75 and 85 of the relay main body 20 described later protrude respectively as well as with protruding portions 17 and 17 which can accommodate a gas discharge pipe 21, on its ceiling surface. A partition wall 18 connects the both protruding portions 17 and 17 and these work as an insulating wall. Each engagement hole 19 provided on the lower end portion of the box cover 15 is engaged with each engagement claw 14 provided on the upper end portion of the box case 10, hence to combine the both integrally.

Figure 3:
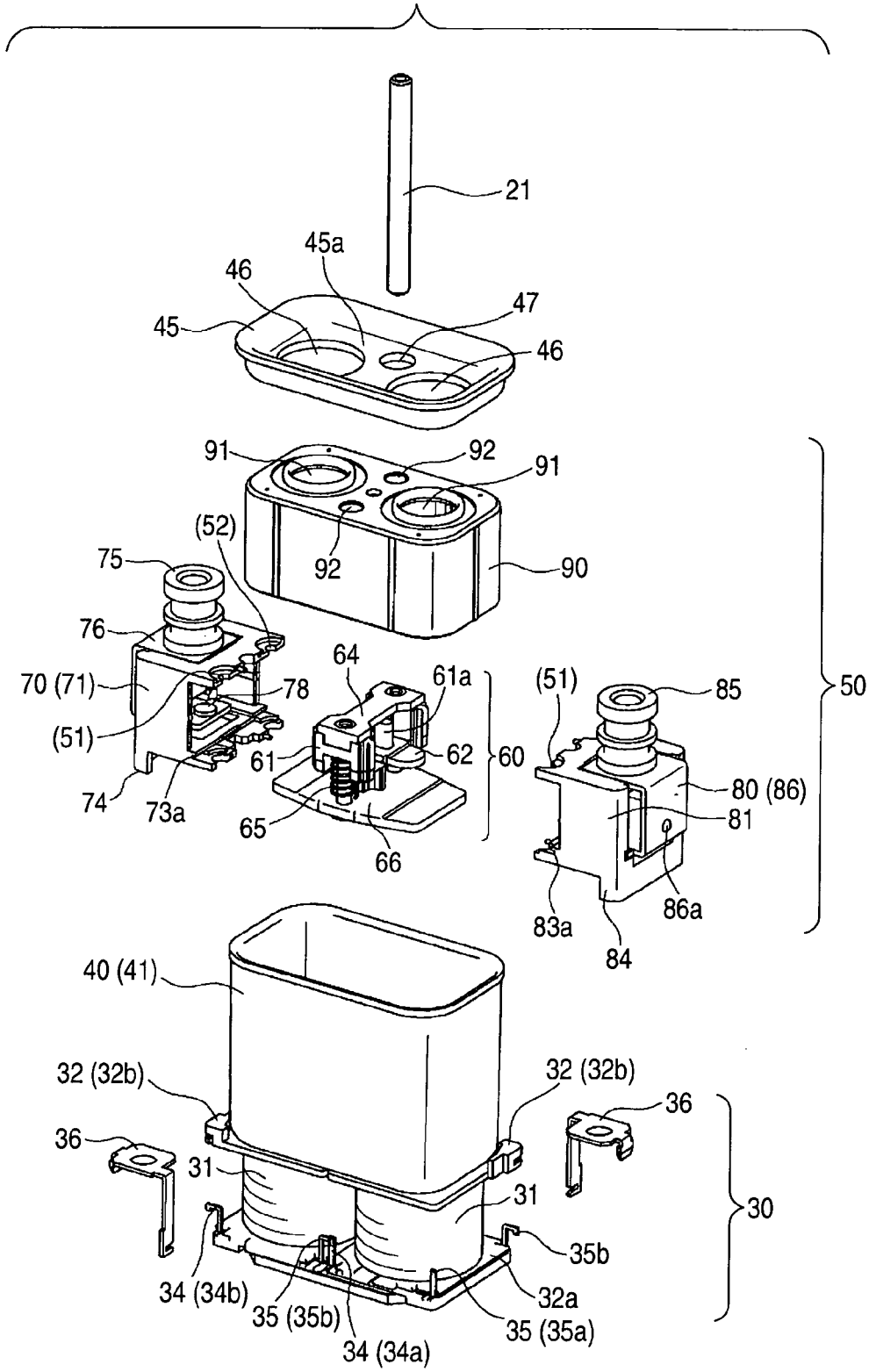
FIG. 3 is an exploded perspective view of the relay main body shown in FIG. 2.

The relay main body 20 is constituted by sealing a contact mechanism block 50 within the sealing case block 40 mounted on the electromagnetic block 30, as illustrated in FIG. 2 and FIG. 3.

Figure 4:
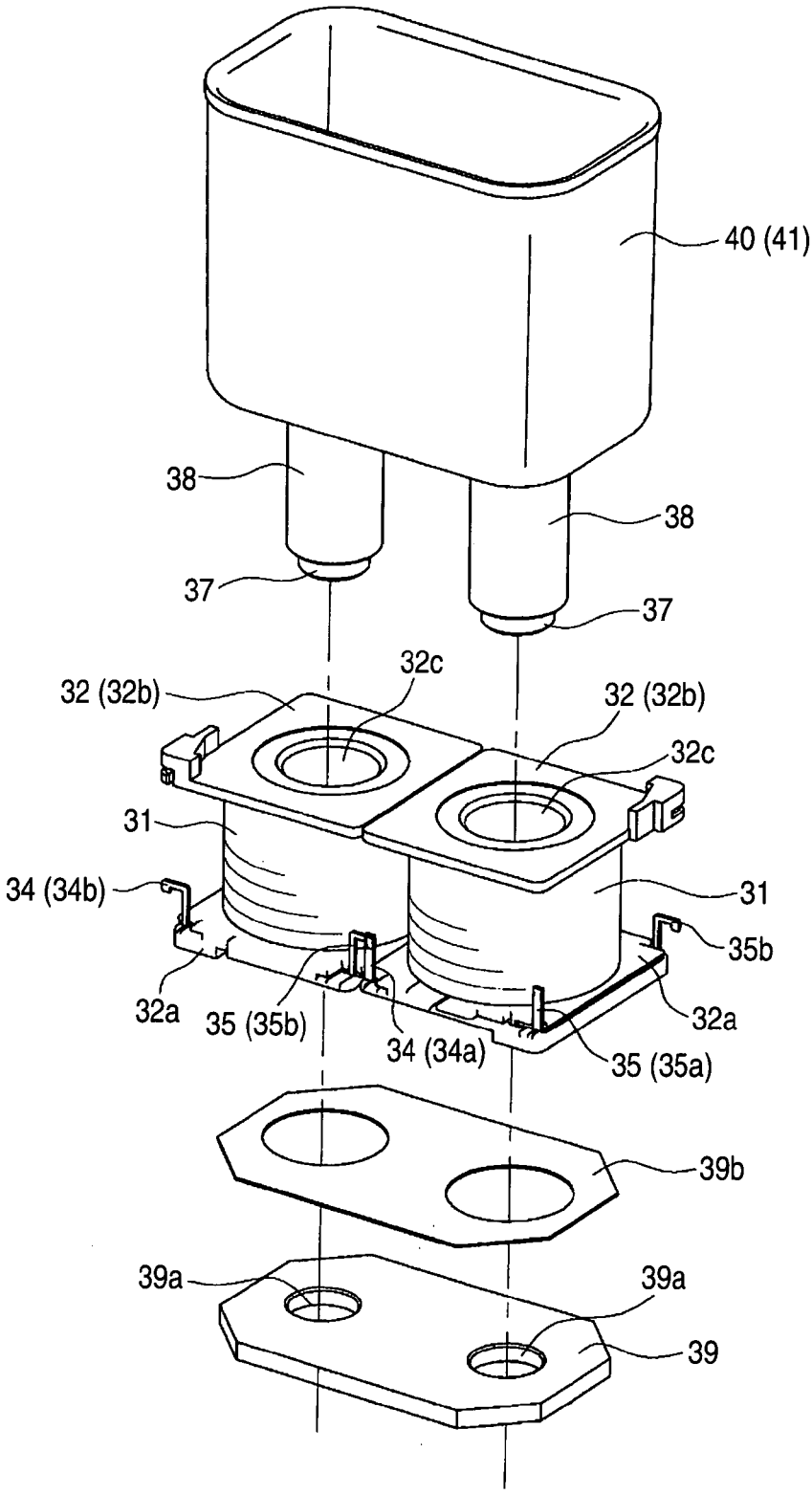
FIG. 4 is an exploded perspective view of the electromagnetic block shown in FIG. 3.
Figure 5:
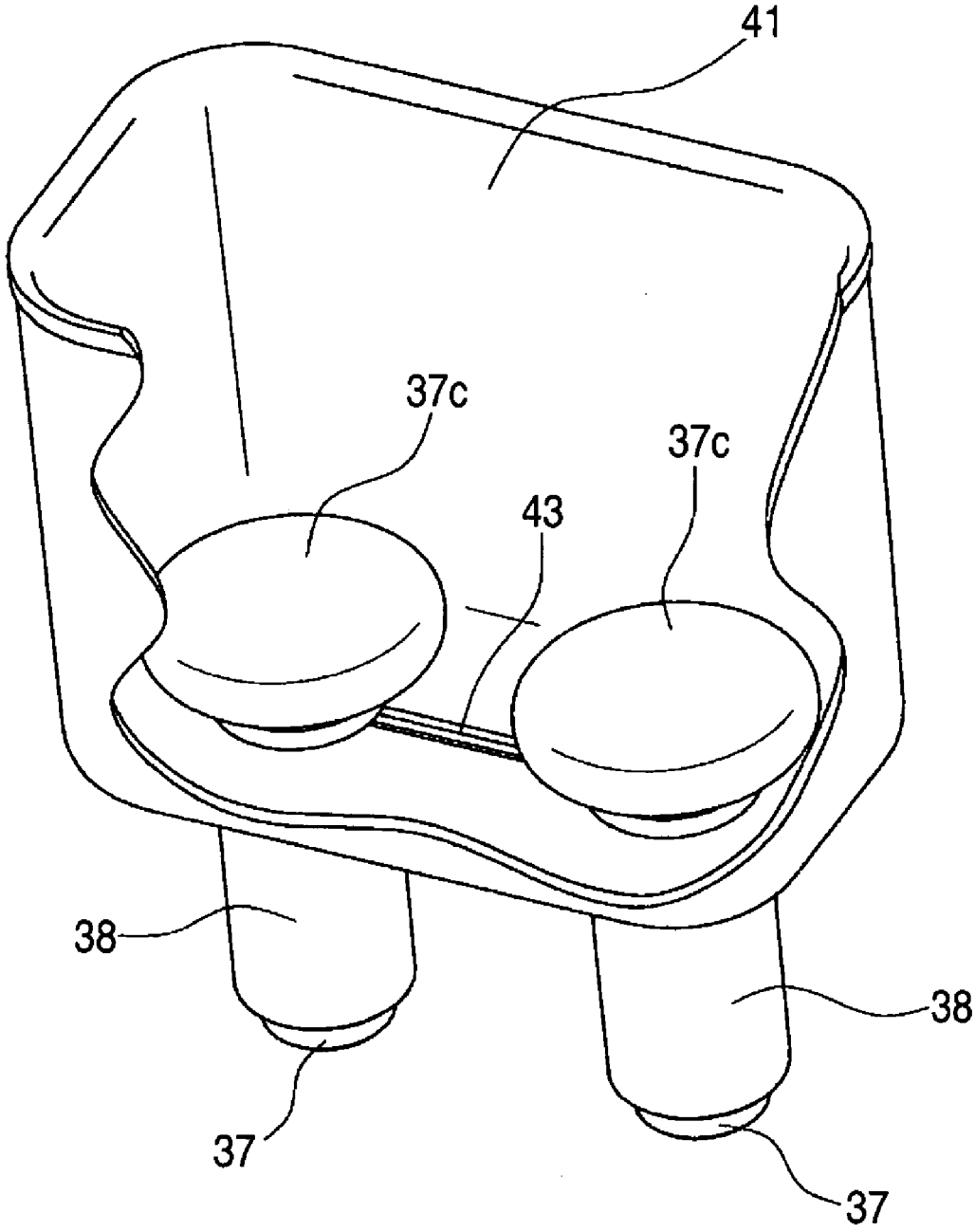
FIG. 5 is a partly broken perspective view of a sealing case shown in FIG. 4.

As illustrated in FIG. 4, the electromagnetic block 30 includes a pair of spools 32 and 32 with coil 31 wound around, combined with two iron cores 37 and 37 integrated with the block and a plate-shaped yoke 39.

In the spool 32, relay terminals 34 and 35 are laterally attached to the lower collar portion 32*a*, of collar portions 32*a* and 32*b* provided on the both upper and lower ends. One end of the coil 31 wound around the spool 32 is entwined with one end (entwined portion) 34*a* of one relay terminal 34 and soldered there and the other end is entwined with the other end (entwined portion) 35*a* of the other relay terminal 35 and soldered there. In the relay terminals 34 and 35, the entwined portion 34*a* is curved and the other end (joint portion) 35*b* is also curved. Of the relay terminals 34 and 35 mounted on the aligned spools 32 and 32, one joint portion 35*b* of one adjacent relay terminal 35 is jointed to the entwined portion 34*a* of the other adjacent relay terminal 34 and soldered there. Further, the entwined portion 35*a* of one adjacent relay terminal 35 is jointed to the joint portion 34*b* of the other relay terminal 34 and soldered there, hence to connect the two coils 31 and 31. The coil terminals 36 and 36 are bridged over the upper and lower collar portions 32*a* and 32*b* of the spools 32 and respectively connected to the joint portions 34*b* and 35*b* of the relay terminals 34 and 35 (FIG. 3).

Figure 6:
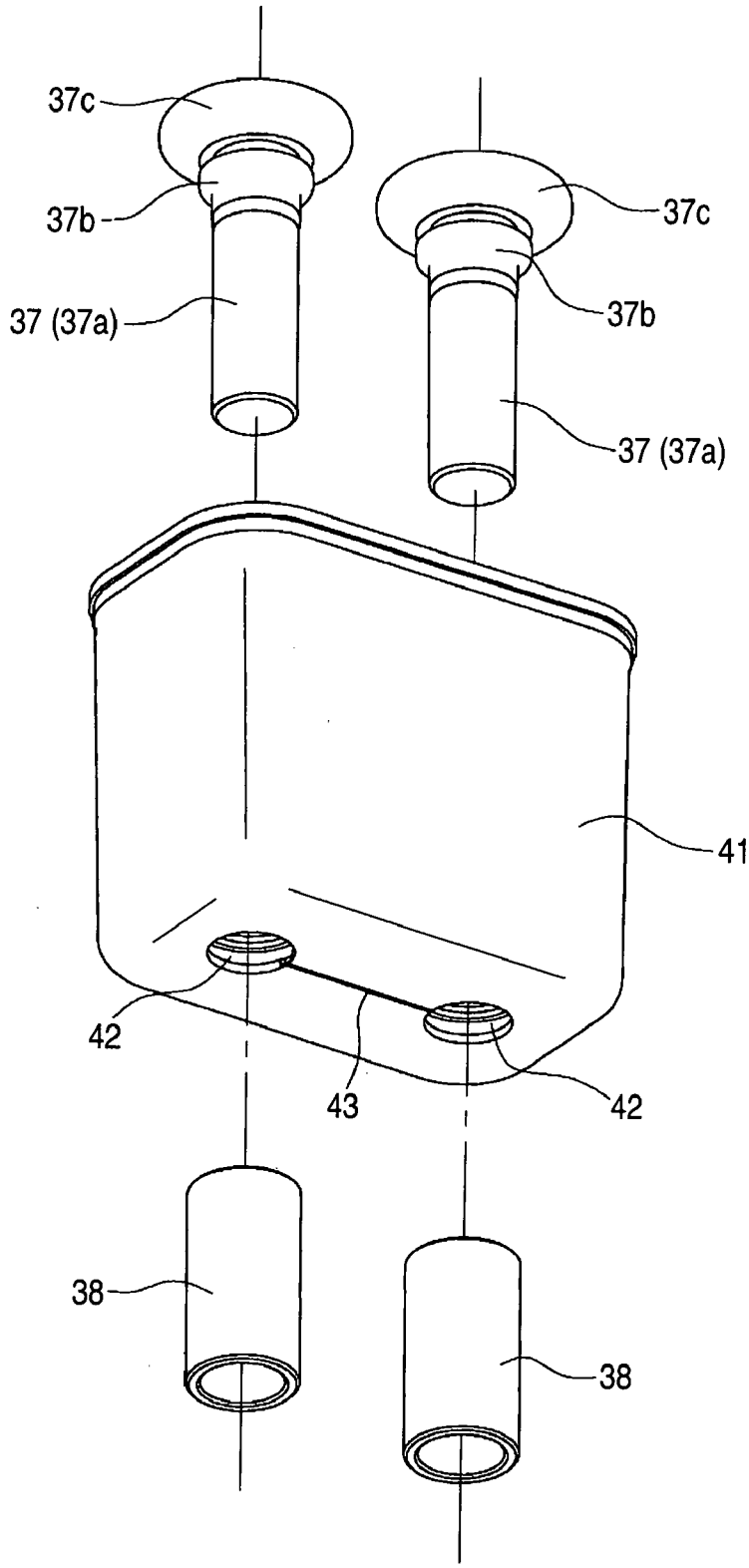
FIG. 6 is an exploded perspective view of the sealing case shown in FIG. 4.

The sealing case block 40 is formed by a sealing case 41 capable of housing the contact mechanism block 50 described later and a sealing cover 45 for sealing the opening portion of the sealing case 41. A pair of fitting holes 42 and 42 for inserting the iron cores 37 is formed on the bottom surface of the sealing case 41 (FIG. 6). A slit 43 for connecting the both holes is provided between the fitting holes 42 and 42. In the sealing cover 45, as illustrated in FIG. 3, a pair of through holes 46 and 46 for penetrating the contact terminals 75 and 85 of the contact mechanism block 50 described later and a loose hole 47 for loosely fitting the gas discharge pipe 21 are provided on the bottom surface of the concave 45*a*.

Assembling the electromagnetic block 30 and the sealing case block 40 is performed in the following procedure.

At first, the relay terminals 34 and 35 are attached to the collar portion 32*a* that is placed at one side of the spools 32, the coil 31 is wound around the spools 32, each drawing line is entwined with each of the entwined portions 34*a* and 35*a* of the relay terminals 34 and 35 and soldered there. A pair of the spools 32 is aligned with the entwined portions 34*a* and 35*a* and the joint portions 34*b* and 35*b* of the relay terminals 34 and 35 curved and raised. The entwined portion 35*a* of the relay terminal 35 is jointed to the joint portion 34*b* of the other adjacent relay terminal 34 and soldered. The joint portion 35*b* of the relay terminal 35 is jointed to the entwined portion 34*a* of the other adjacent relay terminal 34 and soldered there, hence to connect the coils 31 and 31.

As illustrated in FIG. 6, the respective iron cores 37 are inserted into the respective fitting holes 42 provided on the bottom surface of the sealing case 41 and pipes 38 are respectively attached to the shafts 37*a* of the protruding iron cores 37. Each of the pipes 38 is pushed to each of the iron cores 37 from the opening edge of the pipe 38 in a direction of the shaft. In the iron core 37, the diameter of the shaft portion 37*a* is smaller than the diameter of the fitting hole 42 of the sealing case 41 and smaller than the inner diameter of the pipe 38. The diameter of a bottleneck portion 37*b* of the iron core 37 is larger than the diameter of the fitting hole 42 of the sealing case 41 and larger than the inner diameter of the pipe 38. Therefore, when the iron core 37 is pushed down in a direction of the shaft, the bottleneck portion 37*b* of the iron core 37 goes through the fitting hole 42 of the sealing case 41 expanding it and further goes through the pipe 38 expanding the inner diameter of the pipe 38. The opening end portion of the pipe 38 and the head portion (magnetic pole portion) 37*c* of the iron core 37 are fixedly fitted to the opening portion of the fitting hole 42 upwardly and downwardly. The opening portion of the fitting hole 42 of the sealing case 41 is caulked in three directions.

According to the embodiment, since the sealing case 41 is made from material having the thermal expansion coefficient higher than the iron core 37 and the pipe 38, for example, aluminum, it is effective in securing airtightness even when a temperature changes.

Even when each component expands with an increase in temperature, since the expansion of the sealing case 41 in a thickness direction is relatively larger than that of the other components, the sealing case 41 can be more strongly supported by the head portions 37*c* of the iron cores 37 and the pipes 38. While, when each component shrinks with a decrease in temperature, since the shrinkage of the fitting hole 42 of the sealing case 41 in a diameter direction is relatively larger than that of the other components, the bottleneck portion 37*b* of the iron core 37 is choked. In order to retrain generation of thermal stress while securing the airtightness, it is preferable that the thermal expansion coefficient of the iron core 37 is substantially equal to that of the pipe 38.

When the sealing case 41 is made from aluminum that can be easily processed, a sealing work becomes easy and hydrogen becomes difficult to penetrate the case advantageously.

Figure 16A:
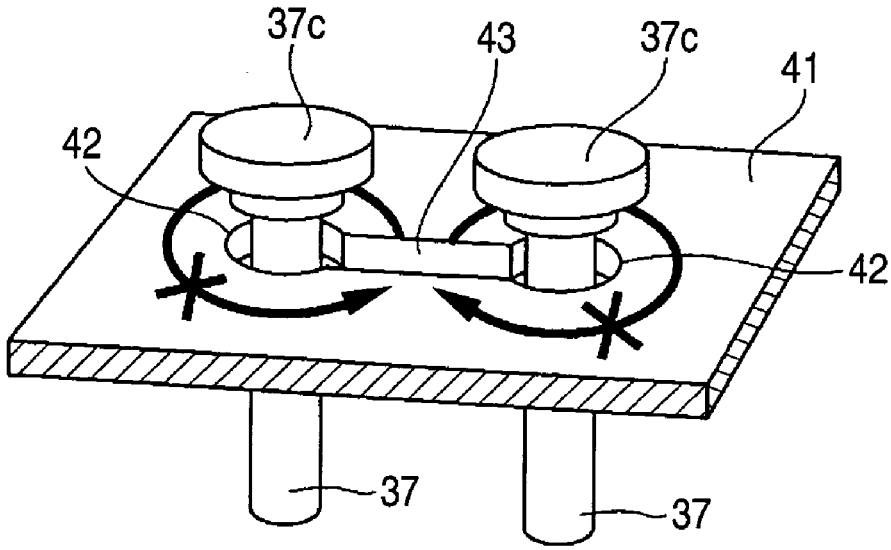
FIG. 16A is a partial perspective view showing the operation principle of the sealing case shown in FIG. 5
Figure 16B:
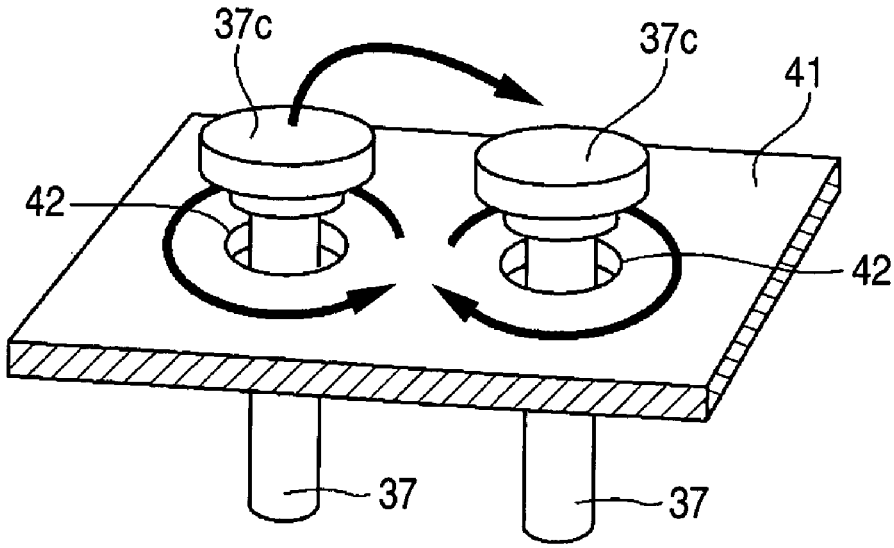
FIG. 16B is a partial perspective view showing the operation principle of the sealing case according to the conventional example.

According to the embodiment, since the slit 43 is provided in the bottom surface of the sealing case 41, even when a change of magnetic flux occurs in the iron core 37, eddy currents can be prevented by this slit, as illustrated in FIG. 16. Therefore, by preventing generation of the magnetic flux caused by the above eddy currents, the return operation of a movable iron piece 66 described later can be smoothly performed. This can restrain the deterioration of the blocking performance caused by a delay of the return operation.

A method for preventing the generation of the eddy currents is not restricted to the above method of providing the slit 43 of connecting the fitting holes 42 and 42 but also, for example, at least one cut-off portion individually formed around each of the fitting holes 42 and 42 may be provided. Generation of the eddy currents may be restrained by forming a rough uneven surface around the fitting holes 42 of the bottom surface of the sealing case 41 to increase the electric resistance.

As illustrated in FIG. 4, the respective iron cores 37 and the respective pipes 38 are inserted into respective center holes 32*c* of the spools 32, so that the respective distal ends of the protruding iron cores 37 go through respective caulking holes 39*a* of the yoke 39, hence to fix the above components firmly. Thus, the electromagnetic block 30 with the sealing case 41 mounted there is completed. An insulating sheet 39*b* in order to enhance the insulation performance is arranged between the yoke 39 and the collar portion 32*a* of the spools 32.

The coil terminals 36 are respectively hung over the upper and lower collar portions 32*b* and 32*a* of the spools 32. The lower ends of the coil terminals 36 are respectively connected to the joints portions 34*b* and 35*b* of the relay terminals 34 and 35. Hence, an assembly work of the electromagnetic block 30 and the sealing case 41 is completed. The sealing material 98 is injected into the bottom of the sealing case 41 and hardened there, to seal the slit 43. The sealing material 98 is made, for example, by adding alumina powder to an epoxy resin and when it is hardened, it has the almost same line expansion rate as aluminum.

The contact mechanism block 50 comprises a movable contact block 60, fixed contact blocks 70 and 80 mounted on the both sides of the block 60, and an insulation case 90 for housing and unitizing these blocks, as illustrated in FIG. 3.

Figure 7:
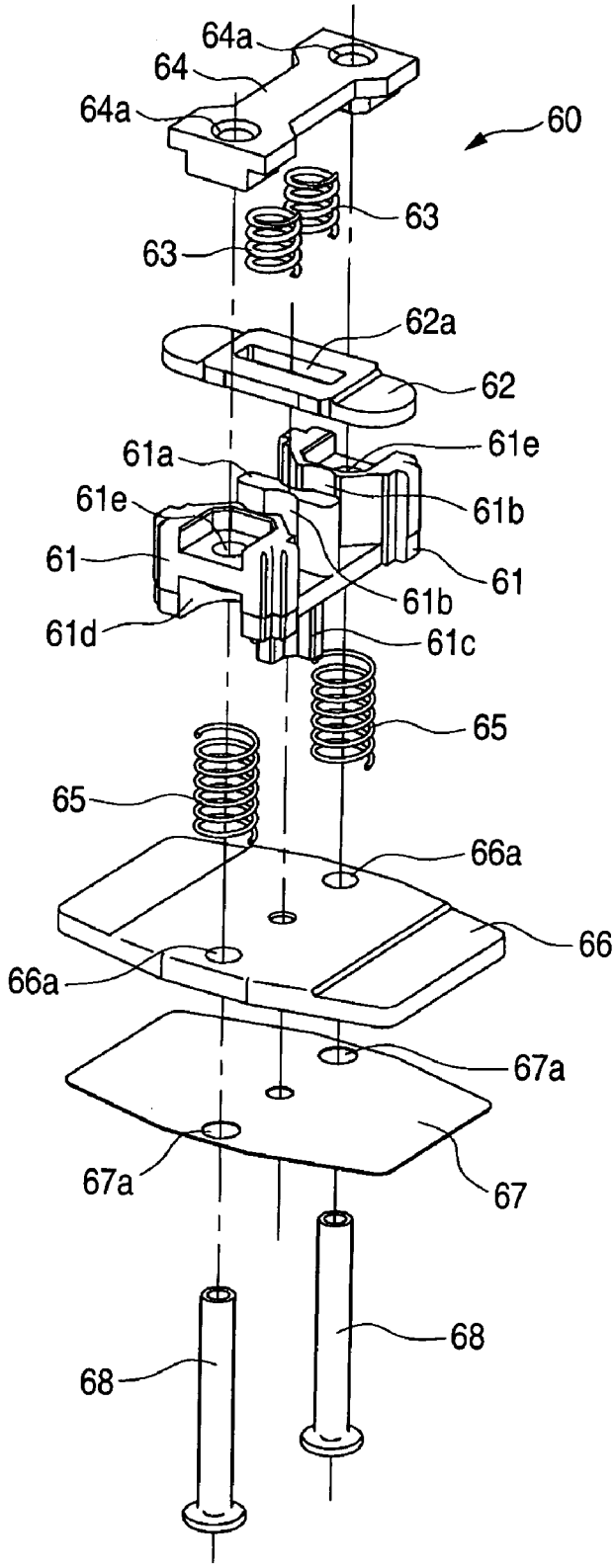
FIG. 7 is an exploded perspective view of a movable contact block shown in FIG. 3.

In the movable contact block 60, a movable contact piece 62 and a pair of coil springs 63 and 63 for pressing contact are mounted on a movable insulation base 61 with a stopper 64, as illustrated in FIG. 7. A pair of return coil springs 65 and 65, a movable iron piece 66, and a shielding plate 67 are firmly staked to the movable insulation base 61 with a pair of rivets 68 and 68.

In the movable insulation base 61, deep grooves 61*b* and 61*b* are formed on the both sides of a guide protrusion 61*a* protruding in the center of the base on its upper surface so as to accommodate the coil springs 63 without dropping them. On the bottom surface of the movable insulation base 61, a leg portion 61*c* having a substantially-cross shaped section is formed in its center and concave portions 61*d* and 61*d* (the back concave portion 61*d* is not illustrated) for positioning the return coil springs 65 are formed on its both sides.

The movable contact piece 62 is designed in that the both ends of band-shaped thick conductive material become semicircle and a guide long hollow 62*a* is provided in its center. The coil springs 63 are to add a contact pressure to the movable contact piece 62 and to always urge the movable contact piece 62 downward.

In assembling the movable contact block 60, at first, the guide long hollow 62*a* of the movable contact piece 62 is fitted to the guide protrusion 61*a* of the movable insulation base 61. Then, a pair of the coil springs 63 and 63 are fitted to the deep grooves 61*b* and 61*b*, and the stopper 64 is attached there. The rivets 68 and 68 are inserted into the return coil springs 65 and 65 positioned within the concave portions 61*d* and 61*d* of the movable insulation base 61, passing through caulking holes 66*a* of the movable iron piece 66 and caulking holes 67*a* of the shielding plate 67. Then, the rivets 68 and 68 are inserted into caulking holes 61*e* and 61*e* of the movable insulation base 61 and caulking holes 64*a* of the stopper 64, thereby staking the above components and completing the assembly work. According to the embodiment, the movable contact piece 62 is always urged downward by the spring force of the coil springs 63 so as not to allow a wobble.

Figure 8:
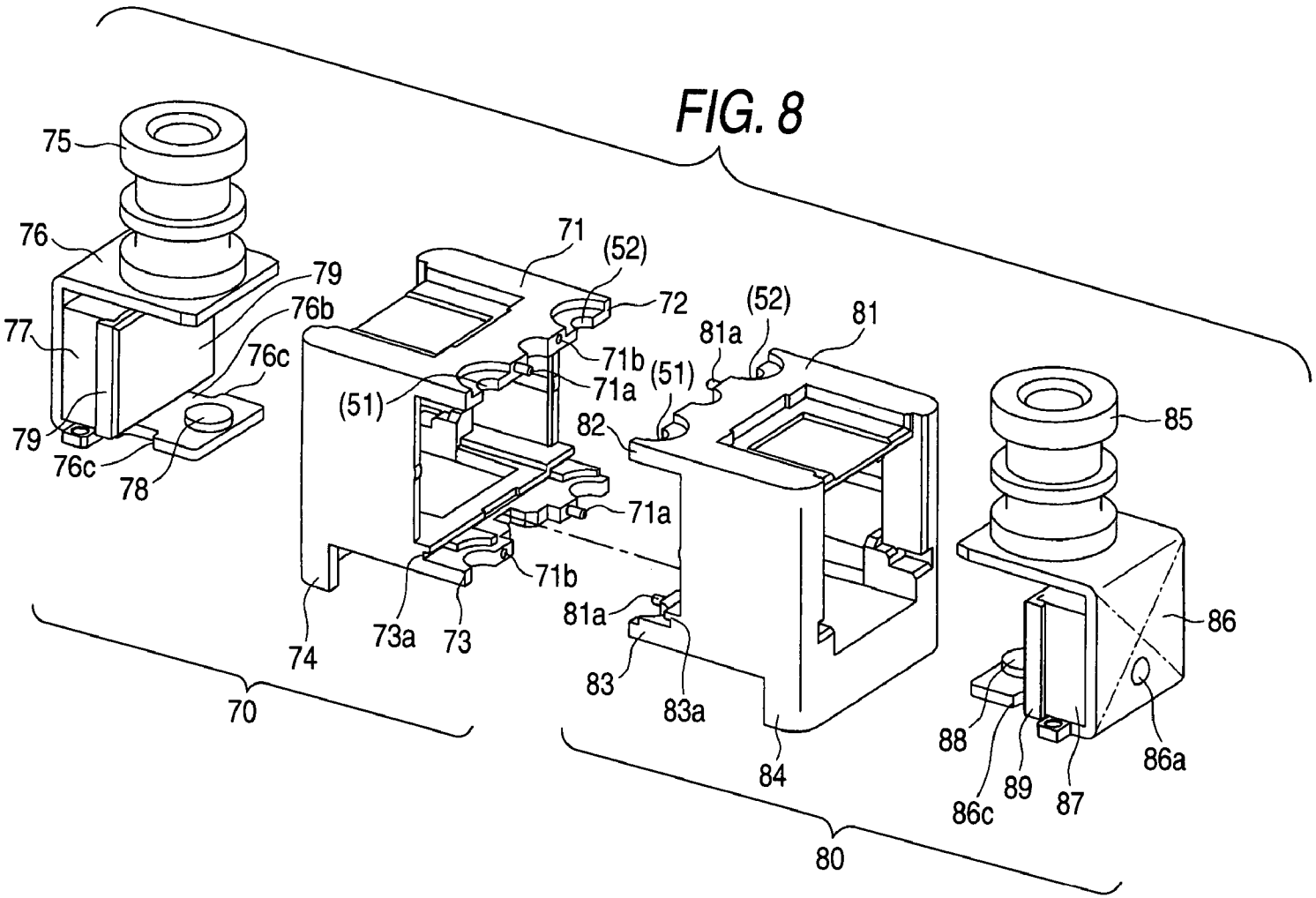
FIG. 8 is an exploded perspective view of a fixed contact block shown in FIG. 3.
Figure 9B:
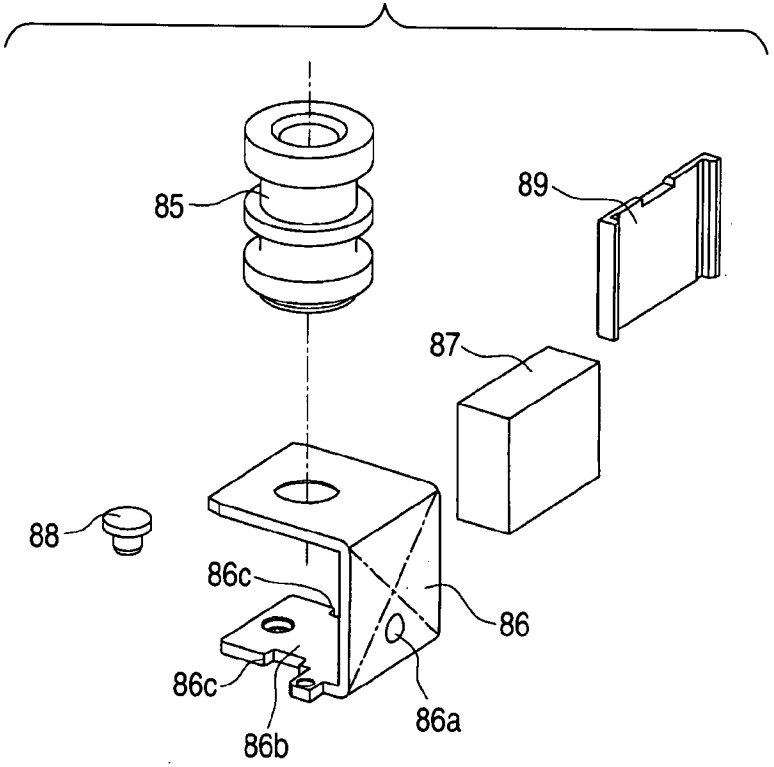
FIGS. 9A and 9B are exploded perspective views of an important portion of the fixed contact block shown in FIG. 8.
Figure 9A:
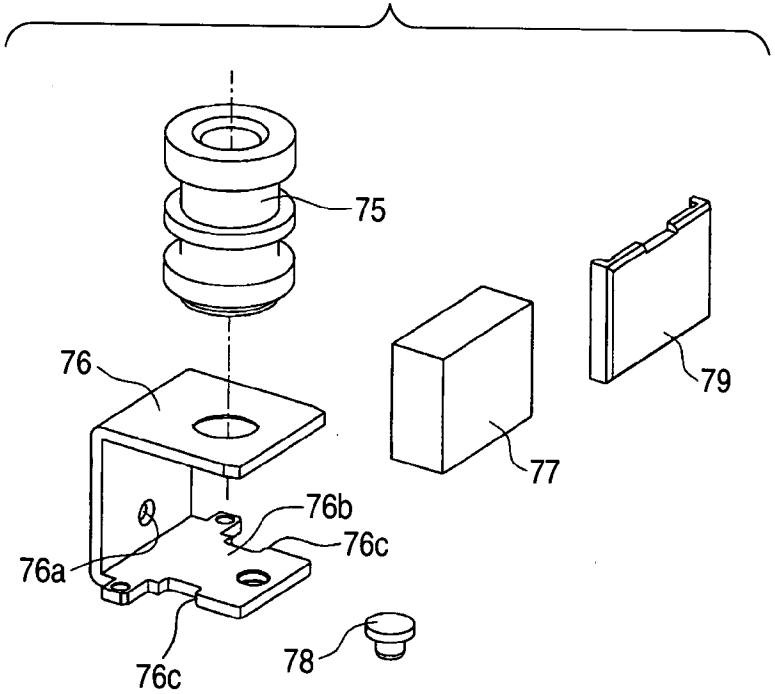

As illustrated in FIG. 8 and FIG. 9, the fixed contact blocks 70 and 80 have the same shape and the same structure. They are formed by attaching the fixed contact terminals 76 and 86 each having a substantially-C-shaped section, with the contact terminals 75 and 85 crimped there, and the permanent magnets 77 and 87, to the fixed contact bases 71 and 81 made from resin.

Figure 14:
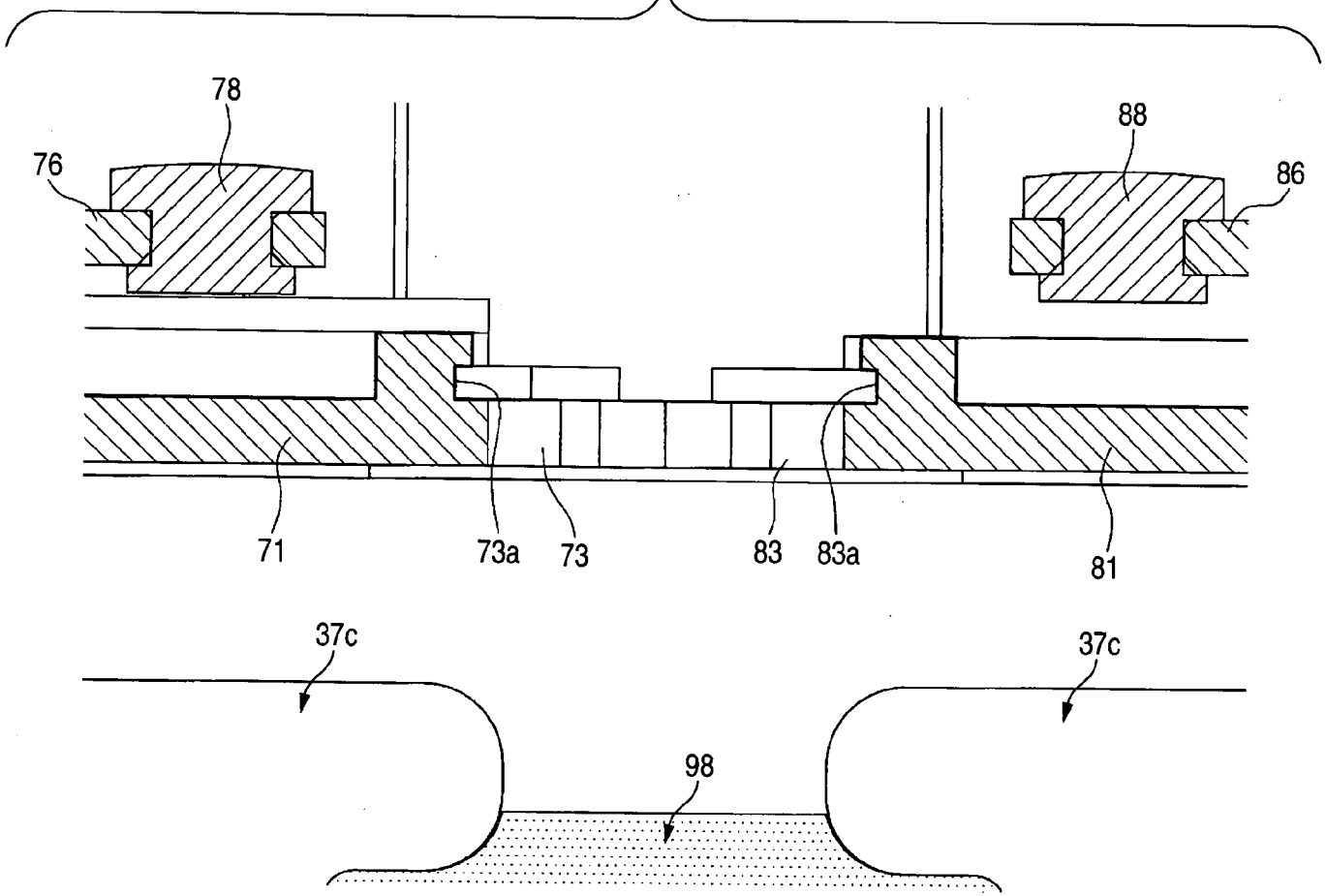
FIG. 14 is an enlarged cross sectional view of an important portion of the direct current breaking relay shown in FIG. 12.

The fixed contact bases 71 and 81 respectively have matching protruding portions 72, 73 and 82, 83 on the upper and lower ends of the bases 71 and 81 on their facing sides. In the protruding portions 72, 73 and 82, 83, in particular, engagement projections 71*a* and 81*a* and engagement holes 71*b* and 81*b* that can be mutually engaged with each other are formed on the surface of the both edges. Further, in the protruding portions 73 and 83, cut-off grooves 73*a* and 83*a* are respectively provided in their basements, as illustrated in FIG. 14, so that they can be a insulating groove in the shape of substantially converted T at the matching time. Even when scattered powder caused at the time of switching contact is scattered around the inner surface, this can prevent the scattered powder from attaching to the inside corners of the cut-off grooves 73*a* and 83*a*, so as not to form a short circuit. It is not necessary to always provide with the both cut-off grooves 73*a* and 83*a*, but only one may be provided, hence to form an insulating groove having a substantially L-shaped section.

As illustrated in FIG. 8 and FIG. 9, the fixed contact terminals 76 and 86 respectively have the fixed contact portions 78 and 88 crimped on their lower end portions and respectively contain the permanent magnets 77 and 87 in their lower corners. Further, the fixed contact terminals 76 and 86 are respectively provided with positioning projections 76*a* and 86*a* each protruding at the position a little lower than the middle of the outer rectangular surface. The projections 76*a* and 86*a* come into close contact with the inner surface of the insulation case 90 described later (FIG. 13), hence to regulate the position of the fixed contact terminals 76 and 86 and improve the positioning accuracy of the fixed contacts 78 and 88. The fixed contact terminals 76 and 86 are respectively provided with narrow portions 76*b* and 86*b* between the fixed contact portions 78 and 88 and the permanent magnets 77 and 87. This means that angles 76*c* and 86*c* are respectively formed in front of the permanent magnets 77 and 87, which prevents generation sources of the arc currents from moving to the permanent magnets 77 and 87.

Figure 10A:
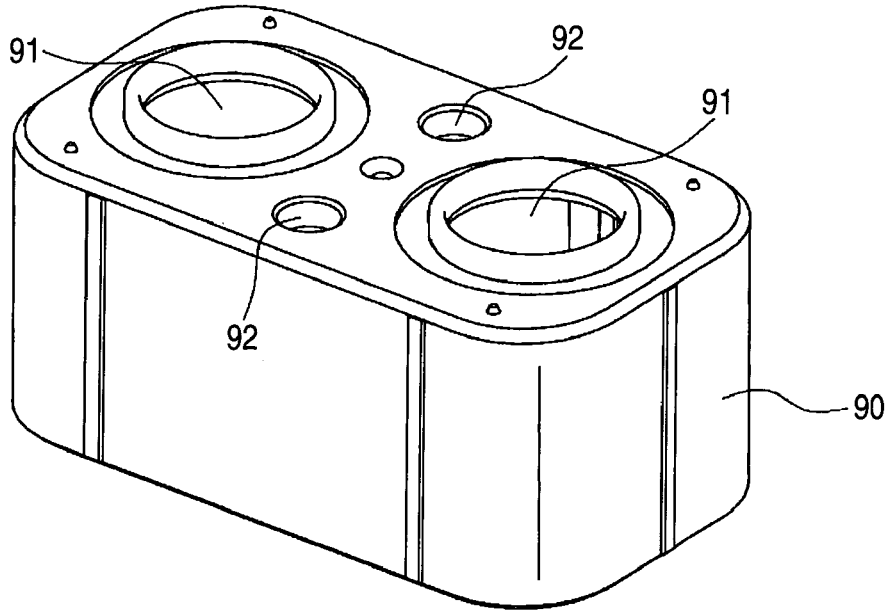
FIG. 10A is a perspective view of the insulation case shown in FIG. 3
Figure 10B:
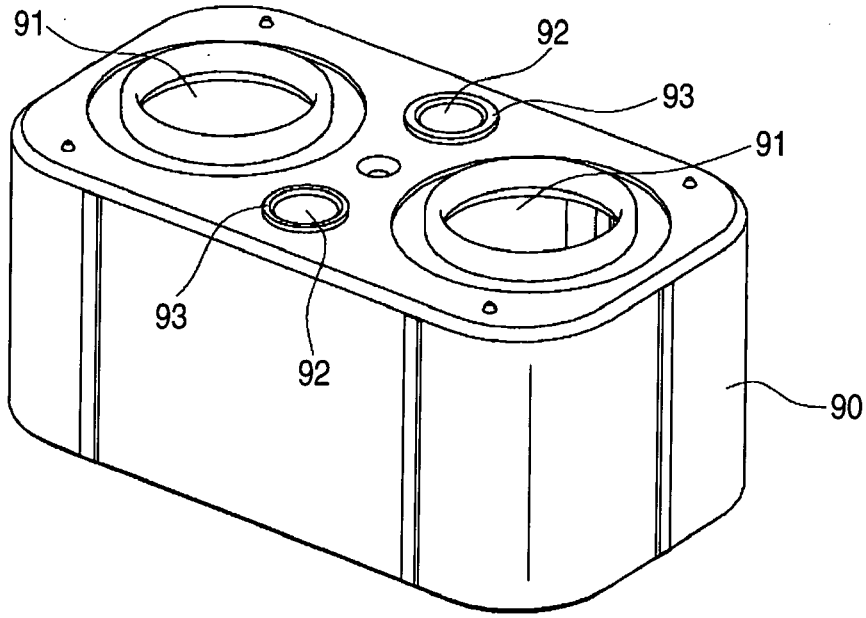
FIG. 10B is a variation example of the insulation case.

The insulation case 90 is to unitize the contact mechanism block 50, as illustrated in FIG. 3. The insulation case 90 is provided with a pair of the gas discharge holes 92 and 92 on the both sides symmetric with respect to a central line connecting the terminal holes 91 and 91 which are provided on the top surface of the case (FIG. 3 and FIG. 10A). It is in order to make the orientation indifferent in the assembly mode that a pair of the gas discharge holes 92 is provided symmetrically. Each circular protrusion 93 for preventing the intrusion of the sealing material may be integrated with each of the opening ends of the gas discharge holes 92 (FIG. 10B).

The procedure of assembling the contact mechanism block 50 will be described below.

Figure 15:
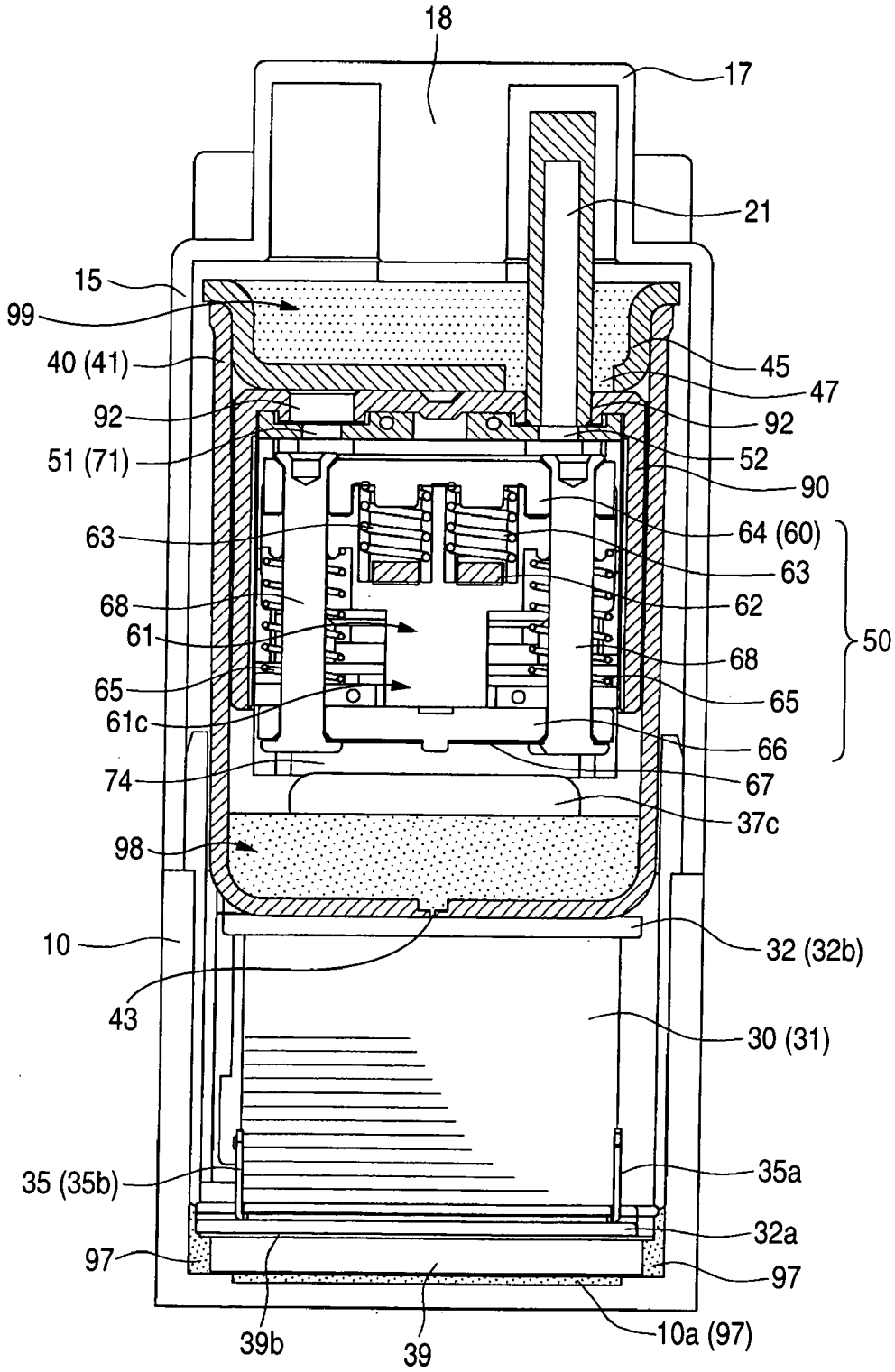
FIG. 15 is a vertical cross sectional lateral side view of the direct current breaking relay shown in FIG. 1.

While pulling up each lower end of the return springs 65 of the assembled movable contact block 60, the fixed contact blocks 70 and 80 are attached to the movable insulation base 61 on its both sides, and the engagement projections 71*a* of the respective matching protruding portions 72 and 73 are respectively engaged into the engagement holes 81*b* of the respective matching protruding portions 82 and 83, and the engagement holes 71*b* of the respective matching protruding portions 72 and 73 are engaged with the engagement projections 81*a* of the respective matching protruding portions 82 and 83. According to this, respective operation holes 51 and 52 are formed between the both fixed contact bases 71 and 81. After attaching the insulation case 90 to the fixed contact blocks 70 and 80, the contact terminals 75 and 85 respectively protrude from the terminal holes 91 and 91, hence to complete the contact mechanism block 50. Here, the gas discharge holes 92 and 92 communicate with the operation holes 51 and 52 since they are positioned on the same axis (FIG. 15).

Figure 11A:
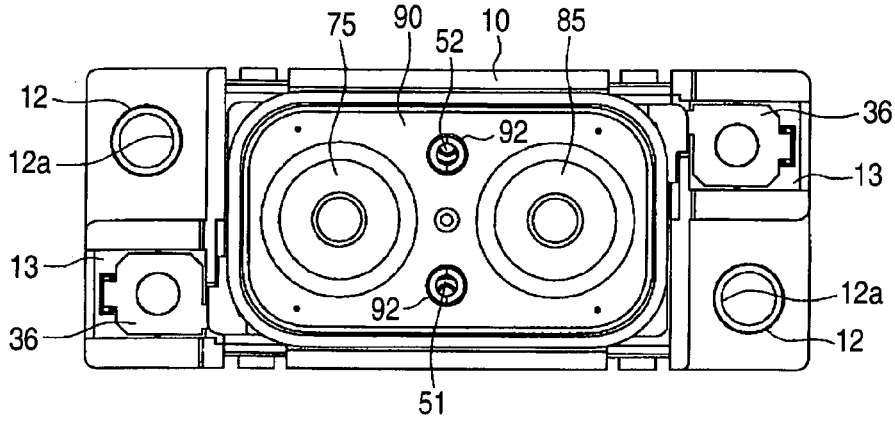
FIGS. 11A, 11B, and 11C are plan views showing the sealing process.
Figure 11B:
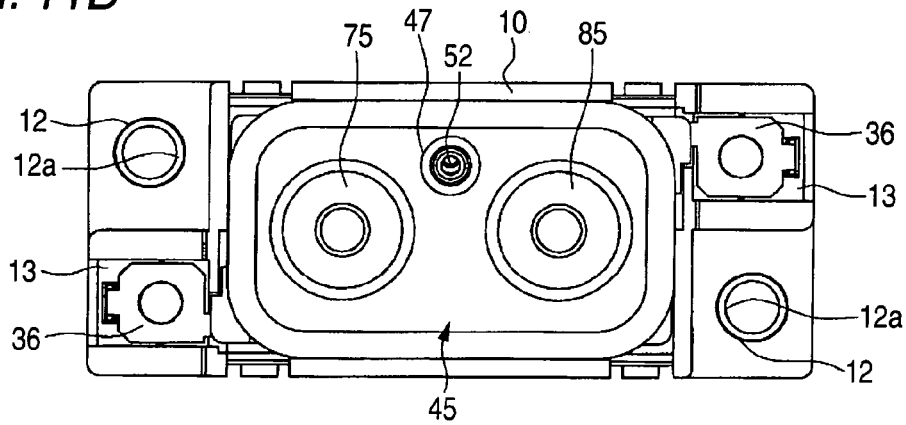
Figure 11C:
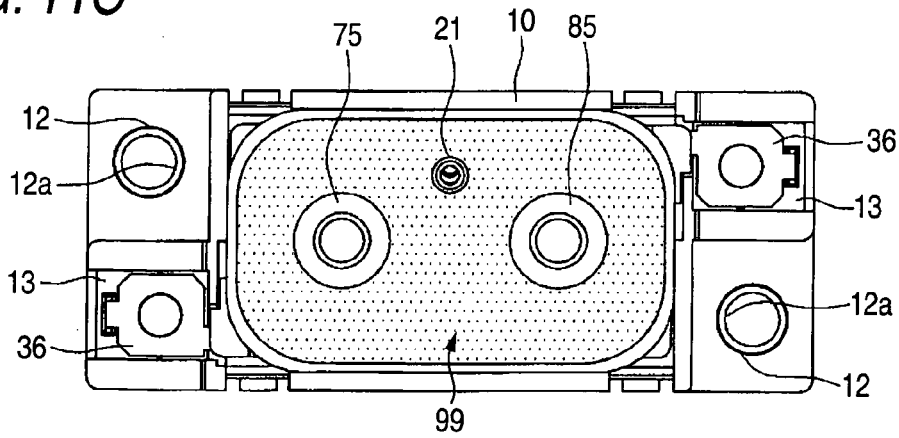

When the contact mechanism block 50 is inserted into the sealing case 41 containing the electromagnetic block 30 (FIG. 12), the leg portions 74 and 84 of the fixed contact bases 70 and 80 respectively come into contact with the head portions 37*c* that are the magnetic pole portions of the iron cores 37, and the movable iron piece 66 faces the magnetic pole portions 37*c* through the shielding plate 67 in a removable way. A pair of measurement probes (not illustrated) are respectively inserted into the operation holes 51 and 52 provided between the respective gas discharge holes 92 and 92 of the insulation case 90 and the respective fixed contact bases 71 and 81. The rivets 68 and 68 cramped to the stopper 64 are pushed or released, in order to move the movable contact block 60 up and down and measure the operation characteristics of the contact pressure and the contact gap. As a result, when the operation characteristic is out of the tolerance level, fine adjustment is performed, while when the operation characteristic is within the tolerance level, the sealing cover 45 is attached to the sealing case 41 and they are welded together (FIG. 11B). A gas discharge pipe 21 is pushed into one of the gas discharge holes 92 of the insulation case 90 from the loose hole 47. The same sealing material 99 as the sealing material 98 made from epoxy resin is injected into the sealing cover 45 and hardened there, so as to seal the basement around the contact terminals 75 and 85 and the gas discharge pipe 21 (FIG. 11C). Air within the sealing case 41 is taken out through the gas discharge pipe 21 and a predetermined mixed gas is injected instead, and then the gas discharge pipe 21 is caulked and sealed. At last, the coil terminals 36 are hung on a pair of the collar portions 32*a* and 32*b* of the spools 32, hence to complete the relay main body 20 (FIG. 2).

According to the embodiment, one of the gas discharge holes 92 is sealed by the gas discharge pipe 21 and the other is covered with the sealing cover 45. Owing to this structure, even when the sealing material 99 is injected, the sealing material 99 will not intrude into the insulation case 90. Since the loose hole 47 for inserting the pipe 21 is positioned at the position equally distant from the respective contact terminals 75 and 85, it has an advantage that the insulating characteristic is good.

A liquid elastic material 97 made from urethane resin is injected in the bottom surface of the recessed portion 11 of the case 10, and the relay main body 20 is accommodated in the recessed portion 11. The coil terminals 36 are positioned at the jointing concaves 13, and the liquid elastic material 97 is hardened there as it is with the relay main body 20 hung within the case 10. The cover 15 is attached to the case 10, hence to complete the direct current breaking relay. In the embodiment, although the liquid elastic material 97 filled and hardened is noise absorbing elastic material, it is not restricted to this but an elastic sheet may be used as a noise absorbing elastic material. The collar portions 32*b* of the spools 32 may be extended and hung within the recessed portion 11 of the case 10.

The operation of the relay having the above structure will be described, this time.

Figure 12:
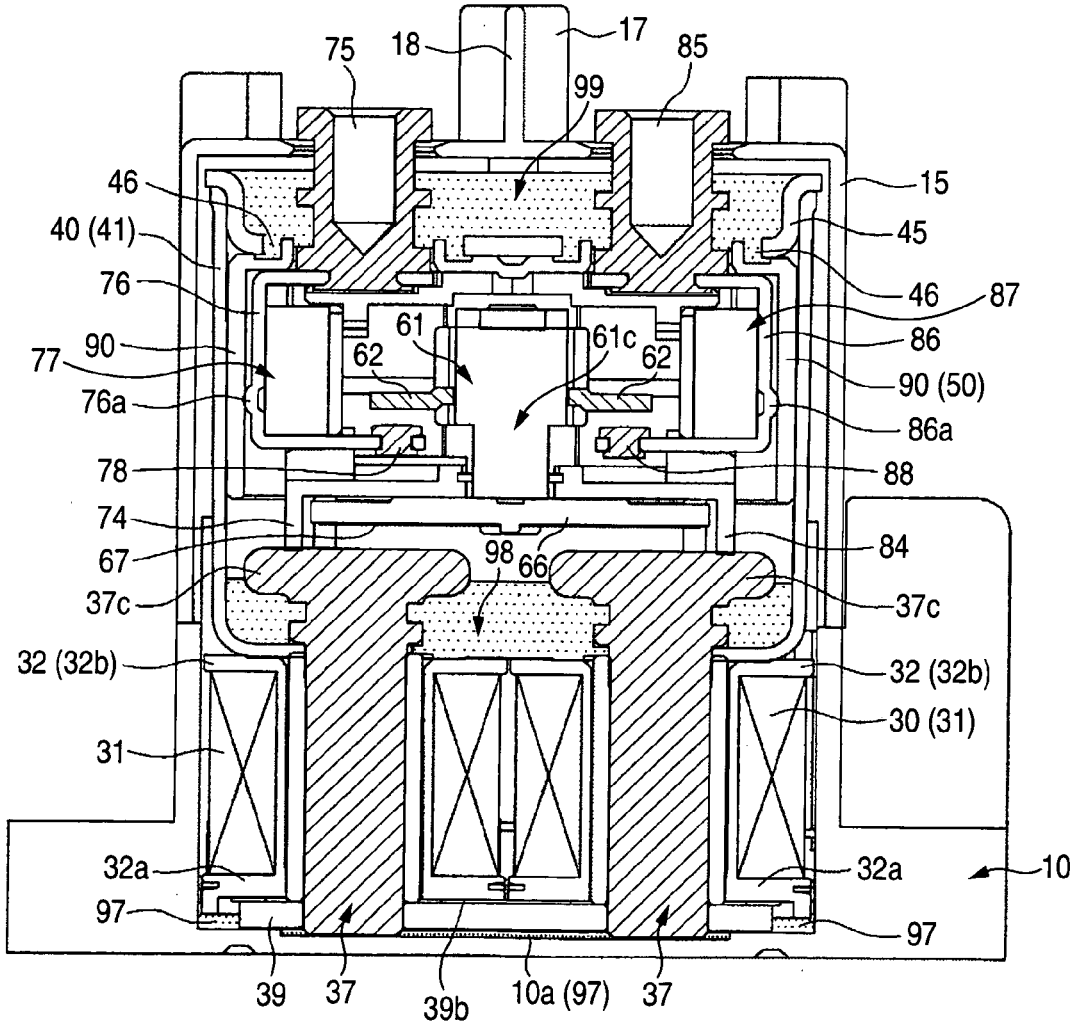
FIG. 12 is a vertical cross sectional front view of the direct current breaking relay shown in FIG. 1.
Figure 13:
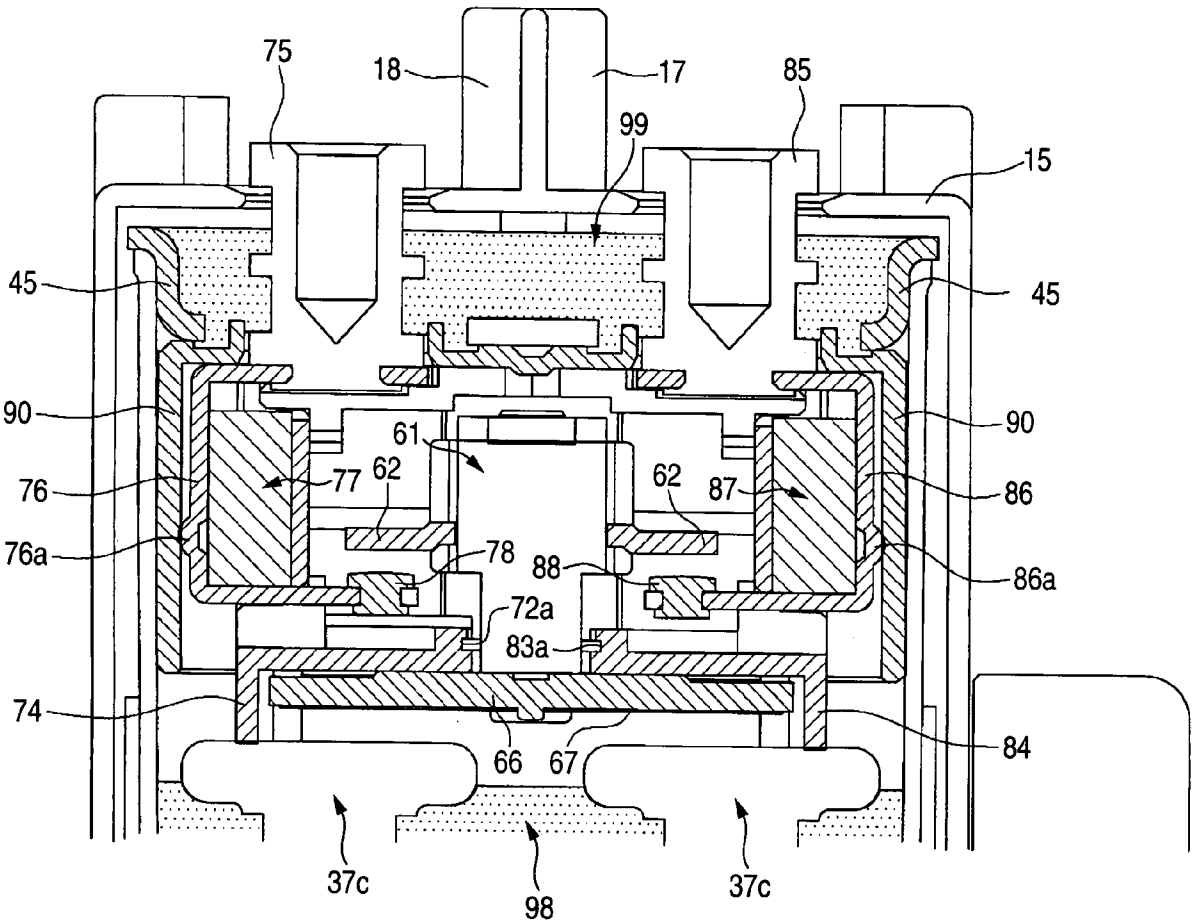
FIG. 13 is a partly enlarged cross sectional view of FIG. 12.

When no voltage is applied to the coils 31 of the electromagnetic block 30, the movable insulation base 61 is pulled up by the spring force of the return springs 65 and 65 (FIG. 12). Therefore, the movable iron piece 66 is separated from the magnetic pole portions 37*c* of the iron cores 37 and the both ends of the movable contact piece 62 are separated from the fixed contacts 78 and 88.

When a voltage is applied to the coils 31, the magnetic pole portions 37*c* of the iron cores 37 absorb the movable iron piece 66, and the movable iron piece 66 moves down against the spring force of the return springs 65. Thus, the movable insulation base 61 integrated with the movable iron piece 66 moves down, and after the both ends of the movable contact piece 62 come into contact with the fixed contacts 78 and 88, the movable iron piece 66 is absorbed by the magnetic pole portions 37*c* of the iron cores 37.

According to the embodiment, since the shock when the movable iron piece 66 comes into contact with the magnetic pole portions 37*c* of the iron cores 37 is absorbed and reduced by the hardened liquid elastic material 97 and the coil terminals 36, collision sound can be restrained, hence to obtain a silent electromagnetic relay advantageously.

When the voltage applied to the coils 31 is stopped, the movable insulation base 61 is raised by the spring force of the return springs 65, the movable iron piece 66 moving together with this is accordingly separated from the magnetic pole portions 37*c* of the iron cores 37, and the both ends of the movable contact piece 62 are separated from the fixed contacts 78 and 88.

According to the embodiment, when the both ends of the movable contact piece 62 contact with and separate from the fixed contacts 78 and 88, the scattered powder is scattered around the inner surface of the fixed contact bases 71 and 81. However, since the cut-off grooves 73*a* and 83*a* are provided on the inner surfaces of the fixed contact bases 71 and 81 as shown by a thick solid line in FIG. 14, the scattered powder will not be attached there fully and a short circuit will not be formed there advantageously.

Figure 17A:
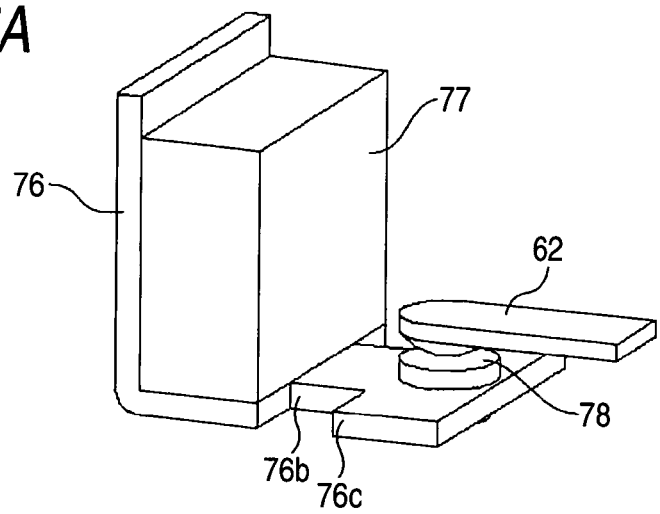
FIGS. 17A, 17B, and 17C are partial perspective views showing the movement of the generation source of the arc current according to the embodiment.

When the both ends of the movable contact piece 62 are separated from the fixed contacts 78 and 88, for example, as illustrated in FIG. 17, even when the arc current 100 is produced and extended from the fixed contact 78 and the generation source of the arc current 100 moves, it will never reach the permanent magnetic 77, which will not damage the permanent magnetic 77 advantageously.

Figure 17B:
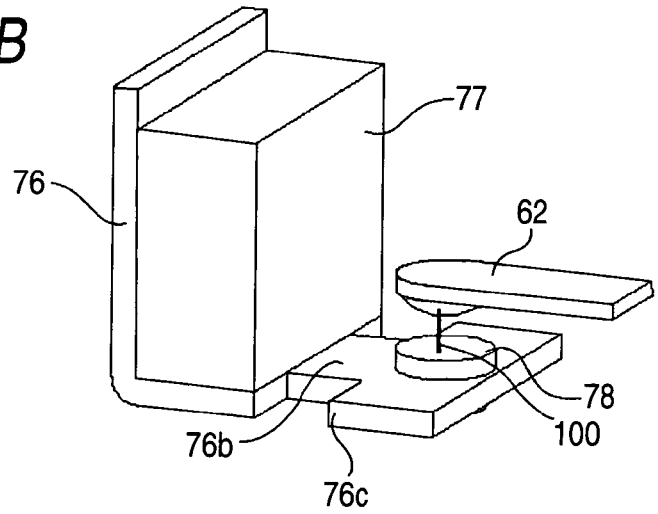
Figure 17C:
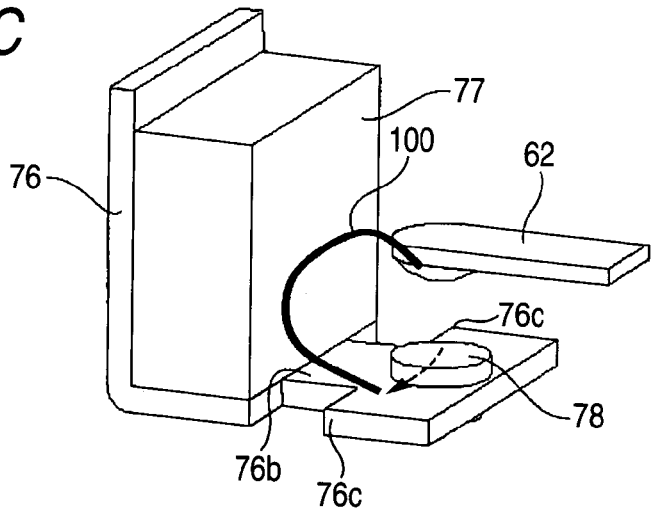
Figure 18A:
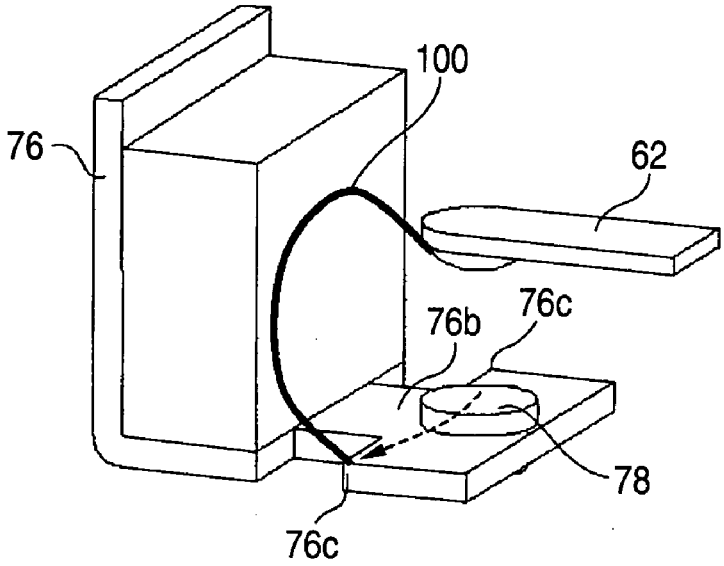
FIG. 18A is a partial perspective view showing the movement of the generation source of the arc current, continued from FIG. 17C
Figure 18B:
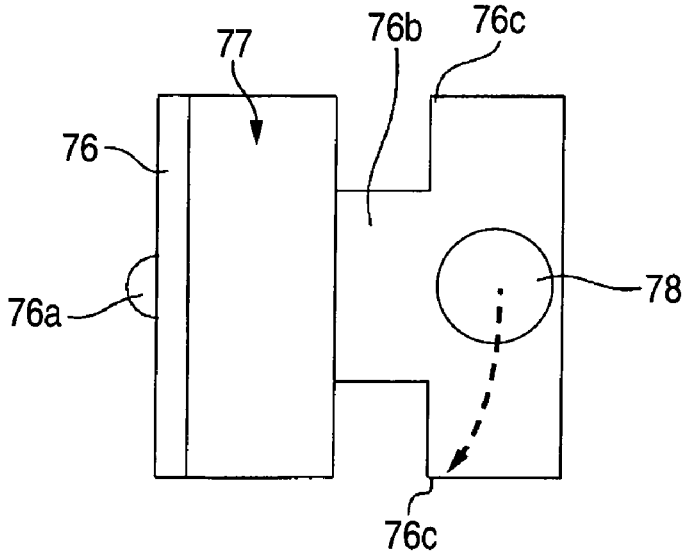
FIG. 18B is a plan view showing the movement of the generation source of the arc current.

More specifically, as illustrated in FIG. 17, even when the arc current 100 is generated in the fixed contact 78 (FIG. 17B) and the generation source of the arc current 100 is attracted by the magnetic force of the permanent magnet 78 and moves (FIG. 17C, FIG. 18A, FIG. 18B), it will never arrive at the permanent magnet 78. This is because the generation source of the arc current 100 has the characteristic of moving to a corner or an angle of the conductive material. According to the embodiment, the narrow portion 76*b* is provided between the fixed contact 78 and the permanent magnet 77, hence to form the angle 76*c* in front of the permanent magnet 77. Therefore, the generation source of the arc current 100 cannot move to the permanent magnet 77 but move to the angle 76*c*.

In the embodiment, although the case of breaking the direct current has been described, the invention is not restricted to this case but it may be applied to the case of breaking an alternative current.

The invention is not restricted to the above-mentioned electromagnetic relay, but it is needless to say that it may be applied to the other electromagnetic relays.

What is claimed is:

1. An electromagnetic relay comprising:

an iron core comprising a protruding shaft and a magnetic pole portion, wherein the protruding shaft is penetrated through a through hole provided on a metal case, a coil is wound around the protruding shaft, and a voltage is applied to the coil for magnetization and stopped for demagnetization, hence to drive a contact mechanism with a movable iron piece that is attracted by and separated from the magnetic pole portion, thereby causing a reciprocating motion of the movable iron piece.

the relay comprising eddy current generation preventing means for preventing generation of eddy current on a surface of the metal case on which the through hole is provided.

2. The electromagnetic relay according to claim 1, wherein the eddy current generation preventing means is at least one slit provided on the surface of the metal case on which the through hole is provided.

3. The electromagnetic relay according to claim 1, wherein the eddy current generation preventing means is at least one cutoff portion provided on the surface of the metal case on which the through hole is provided.

4. An electromagnetic relay comprising:

an iron core comprising a protruding shaft and a magnetic pole portion, wherein the protruding shaft is penetrated through a through hole provided on a stainless steel case, a coil is wound around the protruding shaft, and a voltage is applied to the coil for magnetization and stopped for demagnetization, thereby driving a contact mechanism with a movable iron piece that is attracted by and separated from the magnetic pole portion of the iron core, thereby causing a reciprocating motion of the movable iron piece.

5. The electromagnetic relay according to claim 4, wherein at least one slit for preventing generation of eddy current is provided on a surface of the stainless steel case on which the through hole is provided.

6. The electromagnetic relay according to claim 4 wherein at least one cutoff portion for preventing generation of eddy current is provided on a surface of the stainless steel case on which the through hole is provided.

7. The electromagnetic relay according to claim 2, wherein the eddy current generation preventing means is at least one cutoff portion provided on the surface of the metal case on which the through hole is provided.

8. The electromagnetic relay according to claim 5, wherein at least one cutoff portion for preventing generation of eddy current is provided on the surface of the stainless steel case on which the through hole is provided.

* * * * *